US006416050B1

(12) United States Patent
Niikura

(10) Patent No.: US 6,416,050 B1
(45) Date of Patent: Jul. 9, 2002

(54) AUTO SHEET FEEDER

(75) Inventor: Takeji Niikura, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/461,763

(22) Filed: Dec. 15, 1999

(30) Foreign Application Priority Data

Dec. 18, 1998 (JP) ..... 10-360771

(51) Int. Cl.[7] ..... B65H 9/08; B65H 3/06; B65H 1/12

(52) U.S. Cl. ..... 271/127; 271/117; 271/171; 271/248; 271/241

(58) Field of Search ..... 271/127, 171, 271/117, 118, 241, 248

(56) References Cited

U.S. PATENT DOCUMENTS 5,184,906 A * 2/1993 Czernik et al. ..... 271/127
5,232,214 A * 8/1993 Matsuura et al. ..... 271/127
5,348,283 A * 9/1994 Yangi et al. ..... 271/127
5,437,444 A * 8/1995 Kawakami et al. ..... 271/127
5,632,477 A * 5/1997 Morinaga ..... 271/127
5,918,873 A * 7/1999 Saito et al. ..... 271/127

* cited by examiner

*Primary Examiner*—Christopher P. Ellis
*Assistant Examiner*—Mark A. Deuble
(74) *Attorney, Agent, or Firm*—Fitzpatrick, Cella, Harper & Scinto

(57) ABSTRACT

An auto sheet feeder has sheet supporting means provided on the frame of the main body of the apparatus and supporting sheets thereon, and sheet feeding means for feeding out the sheets supported on the sheet supporting means. A reference surface for regulating one side edge of the sheets fed out by the sheet feeding means is formed on each of the frame and the sheet supporting means.

14 Claims, 8 Drawing Sheets

AUTO SHEET FEEDER

BACKGROUND OF THE INVENTION

1. Field of the Invention

This invention relates to an auto sheet feeder provided in a recording apparatus such as a printer, a copying machine or a facsimile apparatus, and particularly to an auto sheet feeder for automatically separating sheets one by one and feeding them to a recording portion.

2. Related Background Art

In a recording apparatus such as a printer, a copying machine or a facsimile apparatus, besides plain paper, thick paper such as postcards and envelopes and special sheets such as plastic sheets are used as recording sheets. The supply of these recording sheets to the recording apparatus is effected by manually inserting sheets one by one or automatically and continuously feeding sheets by an auto sheet feeder (ASF).

An example of an auto sheet feeder according to the prior art provided in the recording apparatus is shown in FIGS. 7 and 8 of the accompanying drawings. FIG. 7 is a cross-sectional view of an example of the recording apparatus 50 according to the prior art, and FIG. 8 is a front view of an auto sheet feeder 52 provided in this recording apparatus 50.

In FIG. 7, the recording apparatus 50 is provided with a recording portion 53 for recording image information on recording sheets P separated and fed one by one by the auto sheet feeder 52. The recording sheets on which the image information has been recorded in the recording portion 53 are successively discharged from the recording apparatus 50.

The auto sheet feeder 52, as shown in FIGS. 7 and 8, is provided with a pressure plate 55 pivotally provided on a frame 54 and supporting the recording sheets P thereon, feeding rollers 56 for feeding out the recording sheets P supported on the pressure plate 55, a pressure plate spring 58 for biasing the pressure plate 55 toward the feeding rollers 56 and bringing the recording sheets P into pressure contact with the feeding rollers 56, and a separating pawl 59 for separating the recording sheets disposed correspondingly to the corner portion of the leading end of the recording sheets P supported on the pressure plate 55.

The recording sheets P supported on the pressure plate 55 have their opposite side edges regulated by a side reference surface 54*a* formed on the frame 54 and a movable side guide 60 attached to the pressure plate 55 for movement in the widthwise direction of the recording sheets.

The feeding rollers 56, 56 are cut-away circular rollers having a portion of their outer peripheries cut away, and rollers 57, 57 having a diameter somewhat smaller than the outer diameter of the feeding rollers are provided coaxially with the feeding rollers 56, 56. The pressure plate 55 is designed to be capable of spacing the recording sheets P apart from the feeding rollers 56, 56 against the biasing force of the pressure plate spring 58 by a release cam, not shown.

The operation of the auto sheet feeder 52 of such construction will now be described.

When the feeding rollers 56, 56 are rotated while being in pressure contact with the recording sheets P supported on the pressure plate 55, the recording sheets are separated and fed out one by one by the separating pawl 59. The recording sheet thus fed out has its opposite side edges guided by the side reference surface 54*a* and the movable side guide 60 and is conveyed toward the recording portion 53 while the skew feeding thereof is suppressed, and is fed into between a conveying roller 61 and a pinch roller 62 provided in the recording portion 53 by a predetermined amount.

At this time, the pressure plate 55 is spaced apart from the feeding rollers 56 by the release cam, not shown, and the feeding rollers 56, 56 are rotated and stopped at a standby position in which the cut-away surfaces thereof become substantially parallel to the recording sheet. In this state, the rollers 57, 57 are rotated with the conveying operation for the recording sheet to thereby mitigate the load during the conveyance of the recording sheet.

In this manner, a recording sheet is fed out and recording is effected in the recording portion 53 without the recording sheet being skewly fed.

In recent years, the downsizing of the recording apparatus has been desired and therewith, the downsizing of the auto sheet feeder has been contrived. When the downsizing of the auto sheet feeder is contrived, it is conceivable to make the portion for supporting the recording sheets small, but the following problems will arise if it is merely downsized.

(1) When the frame 54 is downsized, the length of the side reference surface 54*a* for guiding one side edge portion of the sheet in the sheet feeding direction becomes short and the skew feeding of the recording sheet occurs or the skew feeding becomes great.

(2) When the movable side guide 60 for regulating the widthwise direction of the recording sheet is made small and thin, the holding force for the recording sheet is weak by only the friction of a molded (resin) part and the regulation of the recording sheet in the widthwise direction thereof cannot be sufficiently accomplished and therefore, the occurrence of the skew feeding of the sheet cannot be suppressed.

(3) When the pressure plate 55 is made small, stress applied to the pressure plate 55 becomes great and the pressure plate is deformed by the occurrence of a creep phenomenon due to long-term preservation. Also, by the pressure plate being small, the surface supporting the recording sheets becomes small and thus, the setting property when the recording sheets are set becomes bad.

Against the occurrence of the above-described skew feeding, it is conceivable to take registration by ramming the recording sheet against the nip portion between the conveying roller 61 and pinch roller 62 stopped to correct skew feeding before the recording operation in the recording portion 53, but when the skew feeding is too great, the skew feeding cannot be sufficiently corrected and moreover, much time is required to take registration and therefore, the evil that the throughput is reduced occurs.

SUMMARY OF THE INVENTION

The present invention has been made in view of the above-noted problems and has as its object to provide a compact auto sheet feeder and a compact image forming apparatus in which the skew feeding of sheets is prevented.

The auto sheet feeder of the present invention is provided with:

- sheet supporting means provided on the frame of the main body of the apparatus and supporting sheets thereon; and
- sheet feeding means for feeding out the sheets supported on said sheet supporting means;
- characterized in that a reference surface for regulating one side edge of the sheets fed out by said sheet feeding means is formed on each of said frame and said sheet supporting means.

DESCRIPTION OF THE PREFERRED EMBODIMENT

Figure 1:
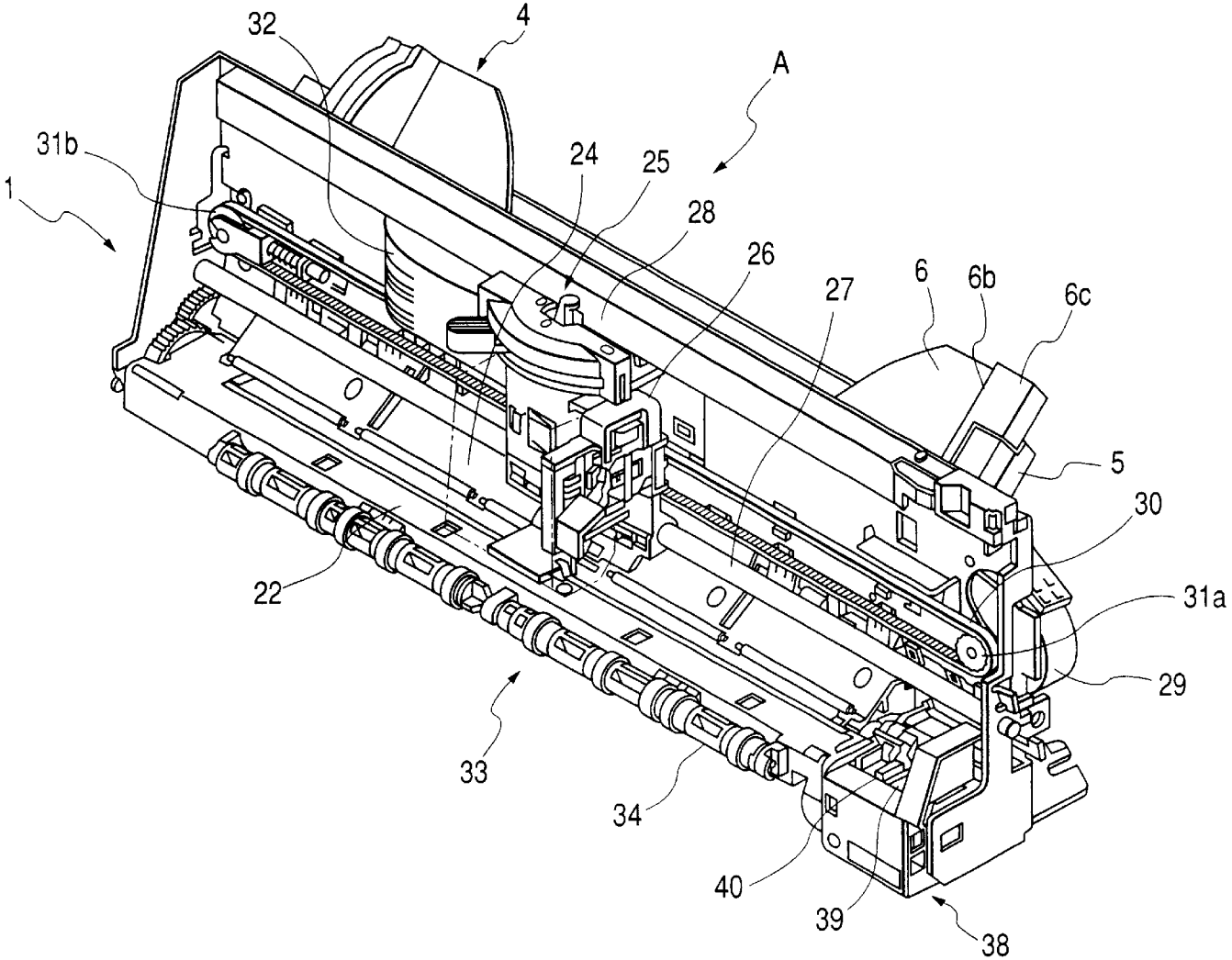
FIG. 1 is a perspective view schematically illustrating the construction of an ink jet recording apparatus to which the present invention is applied.
Figure 2:
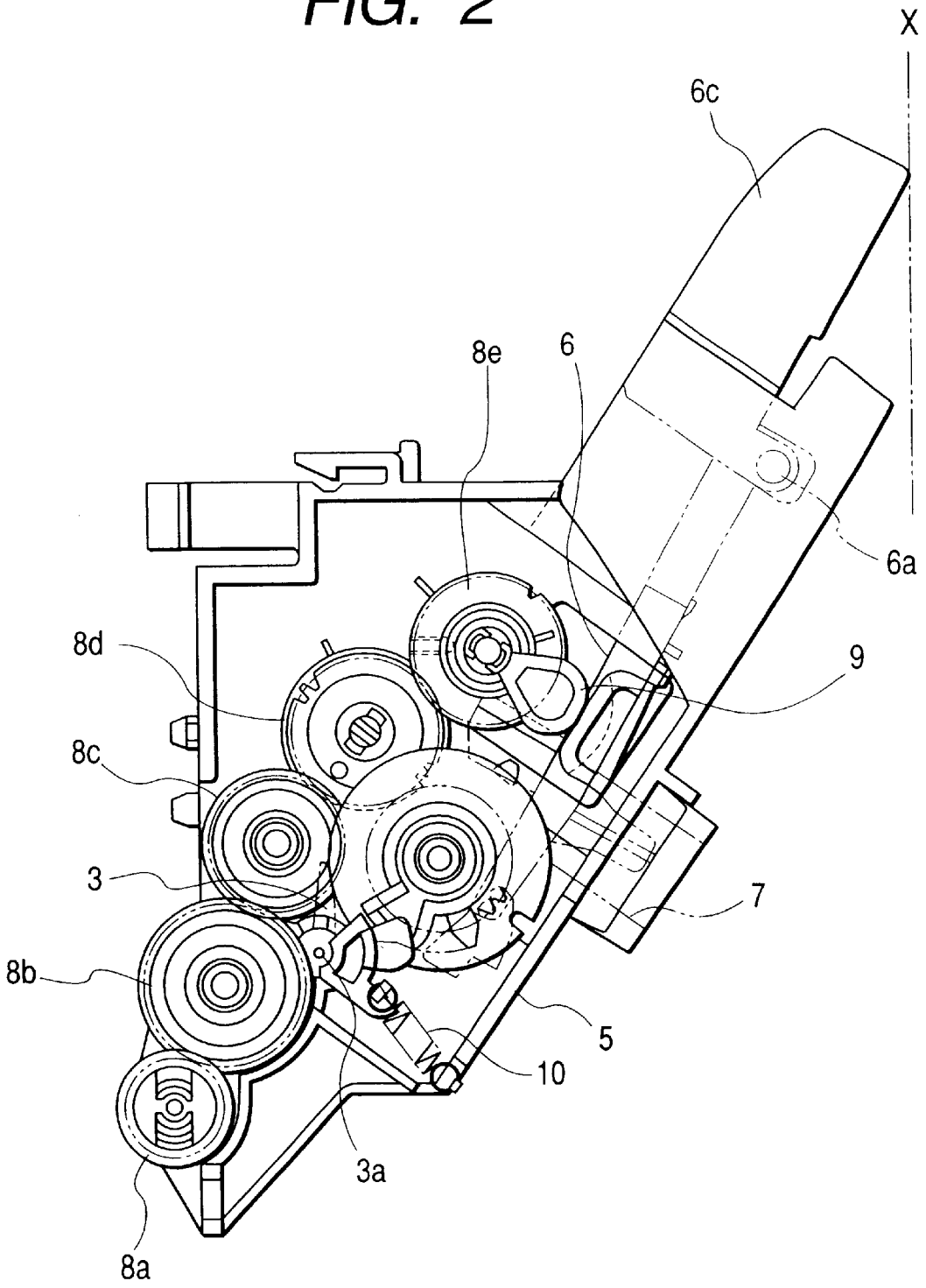
FIG. 2 is a side view of an auto sheet feeder provided in the recording apparatus shown in FIG. 1.
Figure 3:
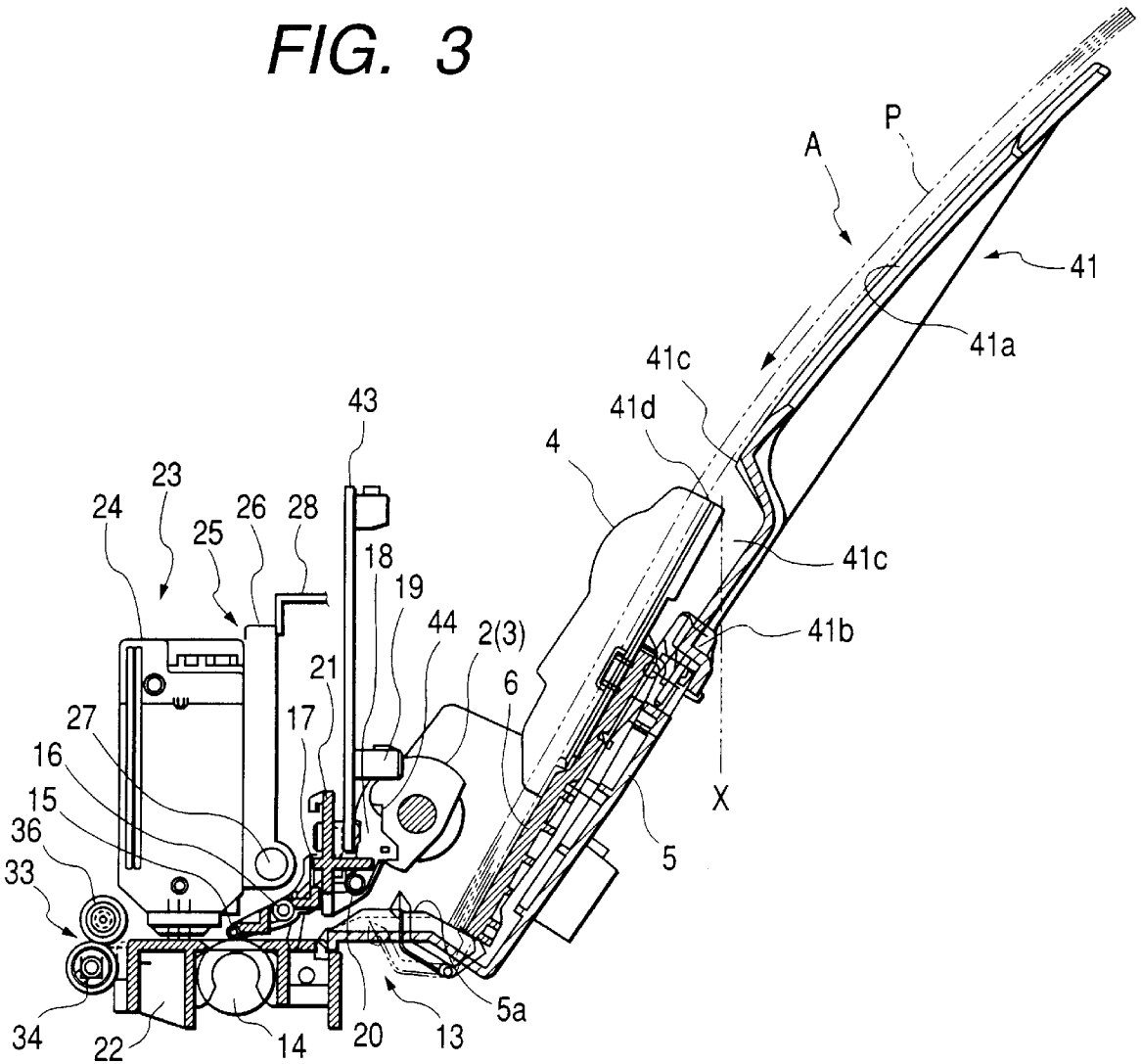
FIG. 3 is a longitudinal cross-sectional view of the recording apparatus shown in FIG. 1.

An embodiment of the auto sheet feeder of the present invention will hereinafter be described with reference to the drawings. In the present embodiment, description will be made of an auto sheet feeder provided in an ink jet recording apparatus. FIG. 1 is a perspective view schematically showing the construction of the ink jet recording apparatus, FIG. 2 is a right side view of the auto sheet feeder, and FIG. 3 is a longitudinal cross-sectional view showing the recording apparatus as it is equipped with the auto sheet feeder.

The construction of the ink jet recording apparatus 1 will first be schematically described. The apparatus shown in the present embodiment is a recording apparatus in which the auto sheet feeder A is integrally provided, and the auto sheet feeder A, as shown in FIG. 3, is mounted with an angle of 30°–60° with respect to main body of the recording apparatus. Design is made such that set recording sheets P are horizontally discharged after recording.

Description will first be made of the constructions of a sheet feeding portion, a recording portion, a sheet discharging portion, etc., and then the sheet feeding means of the present invention will be described.

Sheet Feeding Portion

The sheet feeding portion 13, as shown in FIG. 3, is a portion provided with conveying means used when the recording portion 23 which will be described later effects recording on the recording sheet fed out from the auto sheet feeder A, and is provided with a conveying roller 14 driven by an LF motor, not shown, a pinch roller 15 urged against the conveying roller 14, a PE sensor 19 for detecting the end portion of the recording sheet, an upper guide 21 for guiding the recording sheet, and a platen 22 disposed at a location opposed to a recording head 24 which will be described later.

The pinch roller 15 is mounted on the distal end of a pinch roller guide 16 pivotally supported, and is urged against the conveying roller 14 by the pinch roller guide 16 being biased counter-clockwisely as viewed in FIG. 3 by a pinch roller spring 17. The pinch roller 15 is rotated following the rotation of the conveying roller 14 to thereby create a conveying force for the recording sheet.

The PE sensor 19 serves to detect the recording sheet in conformity with the pivotally moved position of a PE sensor lever 18 pivotally disposed upstream of the pressure contact position (nip portion) between the conveying roller 14 and the pinch roller 15, and the PE sensor lever 18 is biased by a PE sensor spring 20 so as to protrude into the conveying path of the recording sheet.

According to this construction, the leading end of the recording sheet fed out from the auto sheet feeder A pushes the PE sensor lever 18, whereby the PE sensor 19 detects the recording sheet, and for a predetermined time after this detection, the conveying roller 14 is rotated, whereby the recording sheet is conveyed by a predetermined amount to a predetermined recording starting position on the platen 22. Thereafter, the recording sheet is conveyed in accordance with the recording in the recording portion 23 by the conveying roller 14 and a sheet discharge roller which will be described later.

Recording Portion

As shown in FIGS. 1 and 3, the recording portion 23 is provided with a recording head 24 as recording means, a carriage portion 25 for moving the recording head 24, a cleaning portion 38 for effecting the cleaning of the recording head 24, etc.

The recording head 24 serves to record an ink image on the recording sheet conveyed by the conveying roller 14 and the pinch roller 15. This recording method is an ink jet method of discharging ink from the recording head 24 to thereby record. That is, this recording head 24 is provided with a minute liquid discharge port (orifice), a liquid path, an energy acting portion provided in a portion of this liquid path, and energy generating means generating liquid droplet forming energy acting on the liquid in the acting portion.

As the energy generating means generating such energy, there is a recording method using an electro-mechanical converting member such as piezoelectric blocking, a recording method using energy generating means to which an electromagnetic wave such as a laser is applied to thereby generate heat, and discharge liquid droplets by the action of the heat generation, or a recording method using energy generating means for heating liquid by an electro-thermal converting member such as a heat generating element having a heat generating resistor to thereby discharge the liquid.

Among them, a recording head used in the ink jet recording method of discharging liquid by heat energy enables liquid discharge ports (orifices) for discharging liquid droplets for recording to thereby form liquid droplets for discharge to be arranged highly densely and can therefore accomplish recording of high resolution. Above all, a recording head using an electrothermal converting member as energy generating means can be easily made compact and can fully make the most of the recent advance of the technique in the field of semiconductors and the merit of the IC technique and micro-processing technique which are remarkable in the improvement in reliability, and is easy to mount highly densely and is low in the manufacturing cost and thus, it is advantageous.

The carriage portion 25 is provided with a carriage 26 on which the recording head 24 is mounted, a guide shaft 27 for causing the carriage 26 to reciprocally scan in a direction orthogonal to the sheet feeding direction, and a guide 28 for holding the rear end of the carriage 26 and maintaining the distance between the recording head 24 and the recording sheet.

The carriage 26 is connected to a timing belt 30 extended between a driving pulley 31*a* and an idler pulley 31*b*, and the timing belt 30 is rotated by the driving of a carriage motor 29, whereby the carriage 26 is moved. The recording head 24 carried on the carriage 26 is connected to an electric base plate, not shown, on the main body side of the apparatus by a flexible base plate 32 and a head driving signal is transmitted thereto. The recording head 24 is scanned as a unit with the carriage 26 and records an ink image on the recording sheet conveyed on the platen 22. The recording head 24 is constructed integrally with an ink tank and is interchangeable.

The cleaning portion 38, as shown in FIG. 1, is provided with a pump 39 for effecting the cleaning of the recording head 24, a cap 40 for suppressing the desiccation of the recording head 24, a drive changeover arm, not shown, for changing over the drive from the conveying roller 14 to the auto sheet feeder A or the pump 39, etc. The drive changeover arm has a planetary gear, not shown, rotated about the axis of the conveying roller 14 except during sheet feeding and during cleaning fixed at a predetermined position and therefore, the drive from the conveying roller 14 is not transmitted to the pump 39 and the auto sheet feeder A. Also, design is made such that when the carriage 26 is moved to thereby move the drive changeover arm, the planetary gear is moved in conformity with the forward rotation or reverse rotation of the conveying roller 14, and during the forward rotation of the conveying roller 14, the drive is transmitted to the auto sheet feeder A, and during the reverse rotation of the conveying roller 14, the drive is transmitted to the pump 39.

The LF motor for driving the conveying roller 14, etc. and the carriage motor 29 for driving the carriage 26 are stepping motors rotated by a predetermined angle in conformity with a signal sent from a driver, not shown.

Sheet Discharging Portion

The sheet discharging portion 33, as shown in FIGS. 1 and 3, is provided with a sheet discharge roller 34, a transmitting roller, not shown, for transmitting the drive of the conveying roller 14 to the sheet discharge roller 34, a spur 36 for aiding in the discharge of the recording sheets, a sheet discharge tray, not shown, etc. The recording sheet recorded in the recording portion 23 is discharged onto the sheet discharge tray by the sheet discharge roller 34 and the spur 36 without its recording surface being stained.

The construction of the auto sheet feeder A which is an essential portion of the present invention will now be described in detail.

Auto Sheet Feeder

The construction of the auto sheet feeder A will hereinafter be described with reference to FIGS. 1 to 4.

A pressure plate 6 constituting sheet supporting means for supporting the recording sheets P thereon is pivotally provided on the frame 5 of the main body of the apparatus, and a pressure plate spring 7 for biasing the pressure plate 6 toward a sheet feeding roller 2 as sheet feeding means is disposed between the frame 5 and the pressure plate 6. The pressure plate 6 is adapted to be depressed against the biasing force of the pressure plate spring 7 by a release cam 9 as release means so as to be capable of space the recording sheet P apart from the sheet feeding rollers 2, 3. A release cam (not shown) of the same phase as the release cam 9 for depressing the pressure plate 6 is also disposed on the inner side in the plane of the sheet of FIG. 2 (the opposite side in the widthwise direction of the apparatus), and is pushed from the right and left during the depression of the pressure plate 6 by the release cam 9 and therefore, the pressure plate 6 is never twisted.

The sheet feeding roller 2 is an integrally molded article of plastic or the like comprising roller portions 2*a*, 2*b* and a shaft portion 2*c*, and the shaft portion 2*c* has its opposite ends held by the frame 5 and is rotatably provided. Sheet feeding roller rubber urged against the recording sheets P to feed them is twined around the roller portions 2*a*, 2*b*. Each of the roller portions 2*a*, 2*b* is of a D-shaped cross-section (or a half-moon shape) formed with a cut-away portion on a portion of the outer periphery thereof, and rollers 2*d*, 2*e* having a radius of 0.5 mm–3 mm smaller than the radius of the sheet feeding roller rubber are provided outside the respective roller portions 2*a* and 2*b*. These rollers 2*d*, 2*e* serve to frictionally contact with the recording sheet P except during sheet feeding and mitigate the load during sheet feeding by the recording sheet P touching the sheet feeding roller rubber of the sheet feeding roller, thereby preventing the stain of an image and the positional deviation of the sheet feeding roller.

As shown in FIG. 2, the two roller portions 2*a* and 2*b* of the sheet feeding roller 2 are mounted on the shaft portion 2*c*, and are fixed at positions of about 40 mm and about 170 mm from a side reference surface 5*b* formed on the frame 5 for effecting the positioning in the left to right direction during the conveyance of the recording sheet. Accordingly, A4 size or the like is conveyed by the two roller portions 2*a* and 2*b*, and a postcard or the like is conveyed by only one roller portio 2*a* on the side reference surface side.

A separating pawl 3 is disposed in opposed relationship with the corner of the recording sheet P on the leading end side thereof. This separating pawl 3, as shown in FIG. 2, is pivotally supported about a fulcrum 3*a*, and is biased against the recording sheets P or the pressure plate 6 with 20 g to 100 g by a pawl spring 10. The separating pawl 3 serves to effect the separation of the recording sheet which is so-called plain paper S during the feeding thereof, and is provided only on the side reference surface 5*b* side, and is of a shape covering the corner portions of the recording sheets P in a triangular shape.

The recording sheets receive resistance by the triangular portion of the separating pawl 3, whereby they can be separated one by one. Also, recording sheets of great rigidity such as other thick paper than plain paper can be separated one by one by the separating pawl 3 being rotated against the force of the pawl spring 10 by the high rigidity of the recording sheets, and also being rammed against the lower guide portion 5*a* of the frame to thereby use the resistance of this lower guide portion 5*a*.

Drive transmitting means for driving the sheet feeding roller 2 and the release cam 9 is disposed within the frame 5 lateral of the pressure plate 6. This drive transmitting means is provided with a drive input gear 8*a* for receiving the drive from the recording apparatus side, idler gears 8*b*, 8*c*, a sheet feeding roller gear 8*d* connected to the shaft 2*c* of the sheet feeding roller 2, and a cam gear 8*e* connected to the release cam 9.

The operation of the auto sheet feeder A of the above-described construction will now be described. With the recording sheets P set on the pressure plate 6, the drive of the conveying roller 14 is received by the input gear 8*a* of the drive transmitting means and is transmitted to the sheet feeding roller 2 and the release cam 9 through the idler gears 8*b*, 8*c*, the sheet feeding roller gear 8*d* and the cam gear 8*e*. When the release cam 9 is rotated and separates from the pressure plate 6, the pressure plate 6 is pushed up by the pressure plate spring 7 and the recording sheets P come into pressure contact with the roller portions 2*a* and 2*b* of the sheet feeding roller 2.

In this state, the sheet feeding roller 2 is rotated, whereby a recording sheet is picked up, and is separated and fed out by the separating pawl 3. The recording sheet thus fed out is sent to the aforedescribed sheet feeding portion 13.

Each of the sheet feeding roller 2 and the release cam 9 makes one full rotation until they send the recording sheet to the sheet feeding portion 13, and the drive is cut off with the pressure plate 6 again spaced apart from the roller portions 2*a* and 2*b* of the sheet feeding roller 2 by the release cam 9. At this time, the sheet feeding roller 2 is stopped with its cut-away surface being substantially parallel to the recording sheet. This is the initial state.

A sensor plate, not shown, having a radius smaller than the diameter of the sheet feeding roller rubber of the sheet feeding roller 2 is provided on the shaft portion 2*c* of the sheet feeding roller 2. This sensor plate is partly formed with a cut-away portion, and when the sheet feeding roller 2 and the release cam 9 are in the initial state in which they depress the pressure plate 6, a roller sensor 44 comprising a photo-interrupter or the like directly provided on an electric base plate 43 is designed to be in a light transmitting state without intercepting light. By the cut-away portion of this sensor plate being detected, the angular position of the sheet feeding roller 2 and the angular position of the release cam 9 operatively associated with the sheet feeding roller 2 in phase with the latter can be detected. Thereby, the timing of the control in the sheet feeding sequence for the recording sheets can be achieved.

Figure 4:
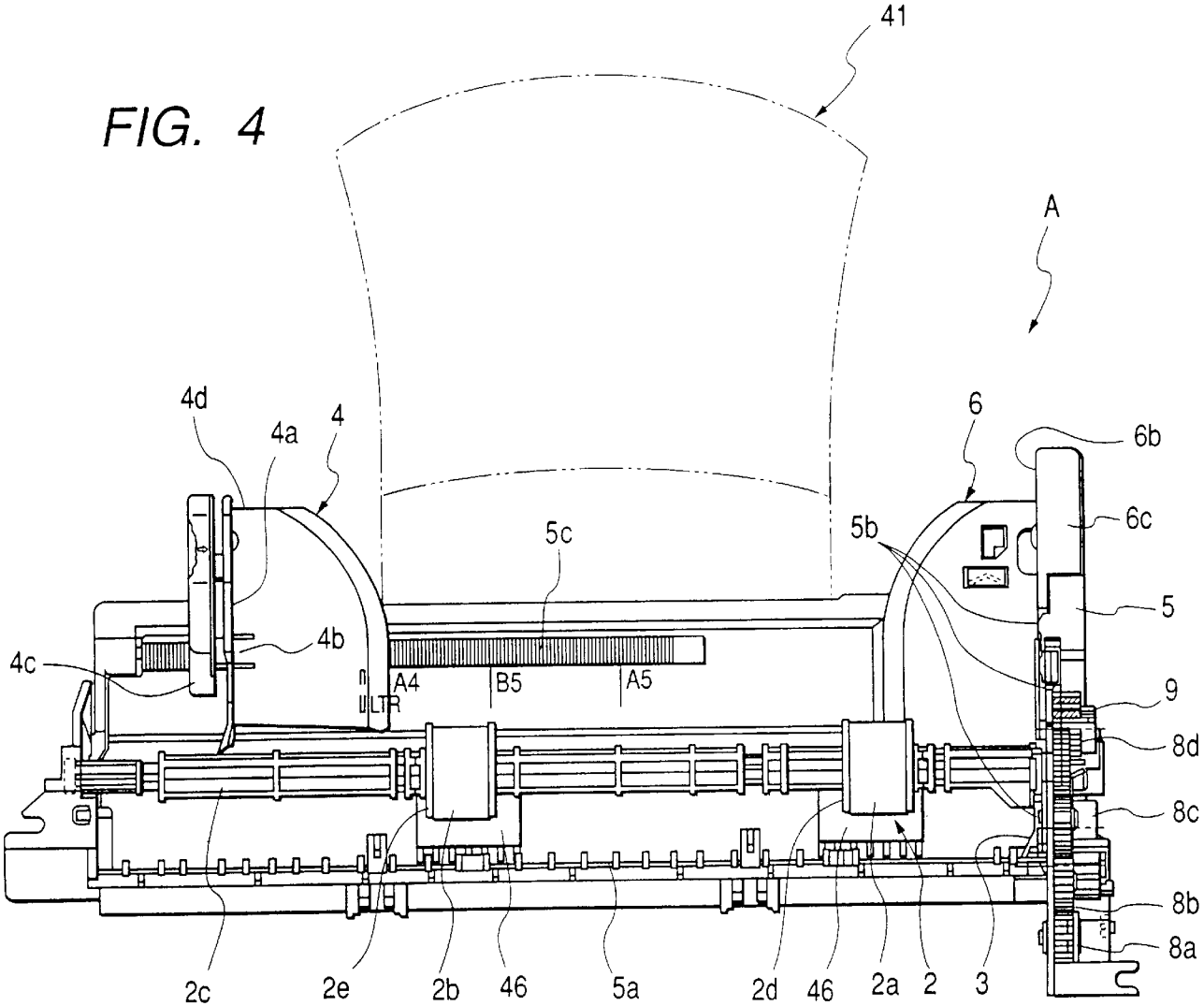
FIG. 4 is a front view of the auto sheet feeder provided in the recording apparatus shown in FIG. 1.

The essential portions of the present invention will now be described in detail. FIG. 4 shows a front view of the auto sheet feeder A. Each part is attached to the frame 5, whereby a unit is constructed. In the present embodiment, sheet feeding is effected with one side edge of the recording sheet as the reference, and the right side plate of the frame 5 is a side reference surface 5*b* which is the conveyance reference. Also, the pressure plate 6 is constituted by a plate-like member long sideways, and as shown in FIG. 2, is coupled to the frame 5 through a pressure plate shaft 6*a* formed on the upper portions of the opposite end surfaces. Thereby, it is pivotally movable about the pressure plate shaft 6*a*. Also, as shown in FIG. 4, separating pads 46, 46 formed of a material having a relatively great coefficient of friction such as artificial leather are provided at locations on the pressure plate 6 which are opposed to the roller portions 2*a* and 2*b* of the sheet feeding roller 2, and prevent double feeding or the like when the number of the recording sheets supported on the pressure plate has become small.

Also, a movable side guide 4 slidable to the right and left is mounted on the pressure plate 6, and regulates the side edge opposite to that side edge of the recording sheet P which frictionally contacts with the side reference surface, whereby recording sheets of different sizes can be set in accordance with the side reference surface 5*c*.

The pressure contact 6 is designed such that when the pressure contact between the sheet feeding roller 2 and the recording sheet P is released, the center thereof is biased by a pressure contact spring 7 and the opposite ends thereof are depressed by the release cam 9, and in order to minimize the creeping phenomenon of molded parts by the lapse of time, the characteristic of the pressure plate 6 is such that the load flexure temperature (ASTM D648, 1.82 MPa/cm$^2$) thereof is 110° C. or higher and the flexural elastic modulus (ASTM D790) thereof is 4000 MPa or greater.

Also, a sheet supply tray 41 having a supporting surface 41*a* for supporting the rear ends of the recording sheets P is provided upstream of the pressure plate 6. The sheet supply tray 41 is detachably mountable to the frame 5 by the coupling portion 41*b* thereof, and is formed with an escape portion 41*c* for securing the movement space for the movable side guide 4. Further, in order to improve the setting property of the recording sheets P, the lower end portion of the supporting surface 41*a* supporting the recording sheets is provided at a location higher than the upper end portion of the pressure plate 6 and the upper end portion 4*d* of the movable side guide 4 with respect to the setting direction of the recording sheets. The supporting surface 41*a* for the recording sheets P is formed into an upwardly convex R-shape (curved shape), whereby the supporting surface 41*a* receives the load of the recording sheets P to thereby avoid that the entire load concentrates in the distal end (the lower abutting surface of the frame 5 against the recording sheets). Thereby, the improved separability of the recording sheets is achieved.

The movable side guide 4 has a fixed portion 4*c* connected to the body portion of a guide surface 4*a* by an arm portion 4*b*, and an uneven portion of the same pitch as or a pitch 1/n time or n times as great as the pitch of the uneven portion of the pressure plate 6 is formed on the free end of the arm portion 4*b* which is opposed to the uneven portion on the pressure plate 6. The uneven portions of these two parts become fitted to each other by the springy property of the arm portion 4*b*, and are fixed to thereby enable the recording sheets to be guided. Also, during the movement of the movable side guide 4, the guide surface 4*a* and the fixed portion 4*c* are picked, whereby the fitted state of the two parts is released and the two parts become movable.

The side reference surface which is the conveyance reference for the recording sheets is constituted by a side reference surface 5*b* provided on the frame 5, and a side reference surface 6*b* provided on a box-shaped reference portion 6*c* formed on the pressure plate 6 so as to protrude toward the upstream side of the frame 5 with respect to the sheet conveying direction, and the recording sheet P is guided and conveyed with the side reference surface 6*b* of the pressure plate 6 and the side reference surface 5*b* of the frame 5 as the reference.

Also, the size of the auto sheet feeder A is up to a sequent X shown in FIGS. 2 and 3, and is a minimum size relative to the guide length of the recording sheet. The pressure plate 6 has its side reference surface 6*b* side protruded toward the upstream side, and the movable side guide 4 is extended toward the upstream side of the central portion of the pressure plate 6. The opposite side edge portions of the recording sheets are supported by the protruded portion of the pressure plate 6 and the extended portion of the movable side guide 4, and the central side of the recording sheets is supported by the supporting surface 41*a* of the sheet supply tray 41.

The above-described construction is a simple construction and yet, according to it, the side reference surface 6*b* is provided on the pressure plate 6 to thereby secure the guide length for the recording sheet, whereby the skew feeding of the recording sheets can be minimized and at the same time, the frame 5 can be downsized and the size of the apparatus itself can also be minimized.

Description will now be made of a construction for suppressing the deviation between the side reference surface 5*b* of the frame 5 and the side reference surface 6*b* of the pressure plate 6.

Figures 5A, 5B:
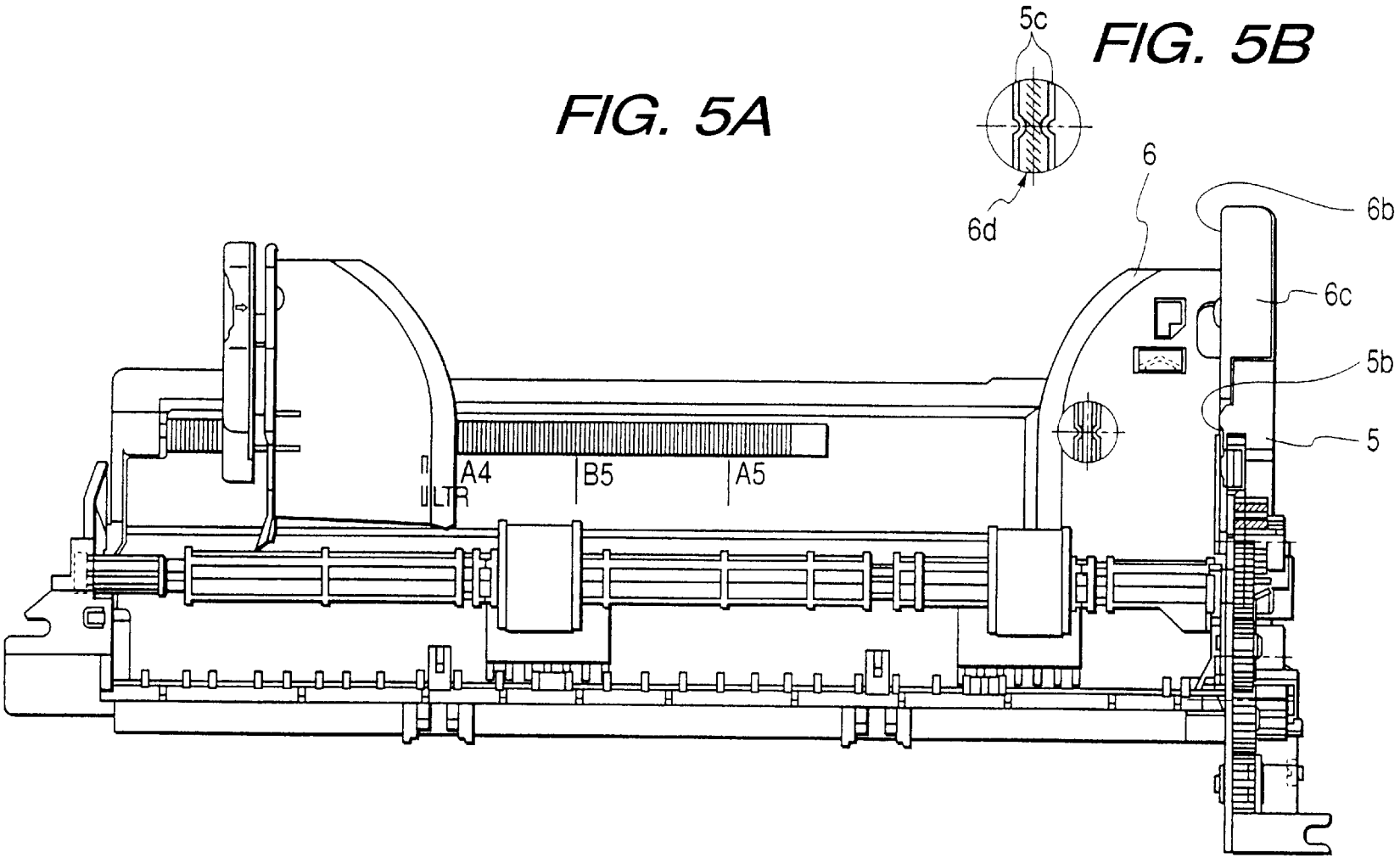
FIG. 5 is a front view partly having a cross-section showing a construction for effecting the positioning of a reference surface.

FIG. 5 is a partly cross-sectional view for showing the positioning portion of the frame 5 and pressure plate 6 in the thrust direction (the left to right direction) thereof. The reference character 5*c* designates a rib formed in the frame 5 and extending in the sheet feeding direction, and the dimension between the apexes of the R portion is formed with high accuracy. This R portion is formed substantially on the axis of the pressure plate shaft 6*a*. On the other hand, the pressure plate 6 is provided with a rib 6*d* extending in the sheet feeding direction and fitted from the back thereof into a gap (between the apexes of the R portion) formed in the frame 5.

According to this construction, the backlash of the frame 5 and the pressure plate 6 in the thrust direction thereof can be reliably suppressed by the unevenness fitting of the ribs, and it becomes possible to minimize the deviation between the side reference surface 5*b* of the frame 5 and the side reference surface 6*b* of the pressure plate 6. Thereby, side reference surfaces of high accuracy free of a level difference or the like can be set long relative to the length of the recording sheets and therefore, the skew feeding of the recording sheets can be reduced. Also, the positioning portion is disposed substantially on the axis of the pressure plate shaft 6*a*, whereby the wear and sliding load of the pressure plate 6 during the vertical movement thereof can be minimized.

Figure 6:
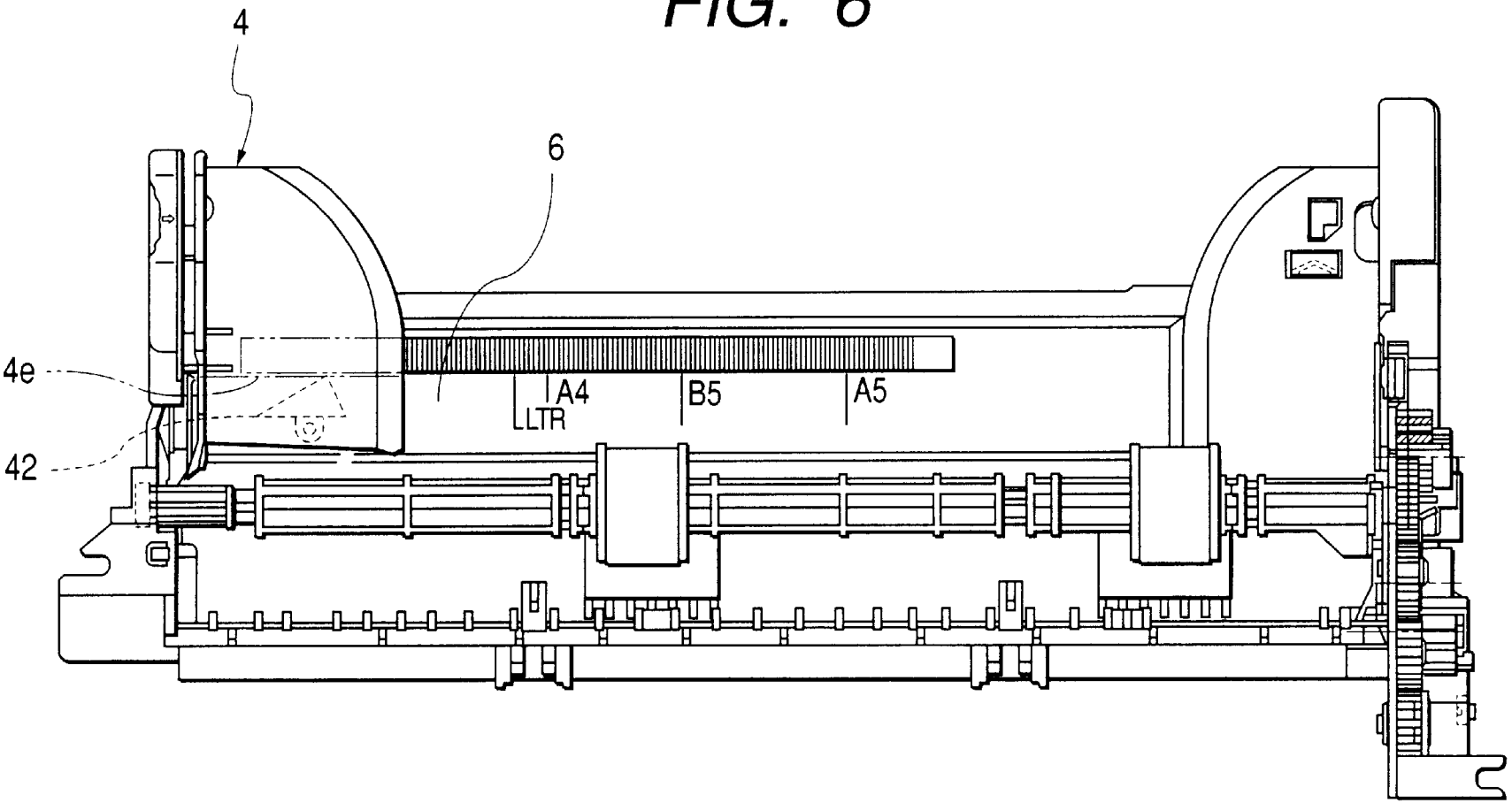
FIG. 6 is a front view showing a construction for enhancing the holding force of a movable side guide.
Figure 7:
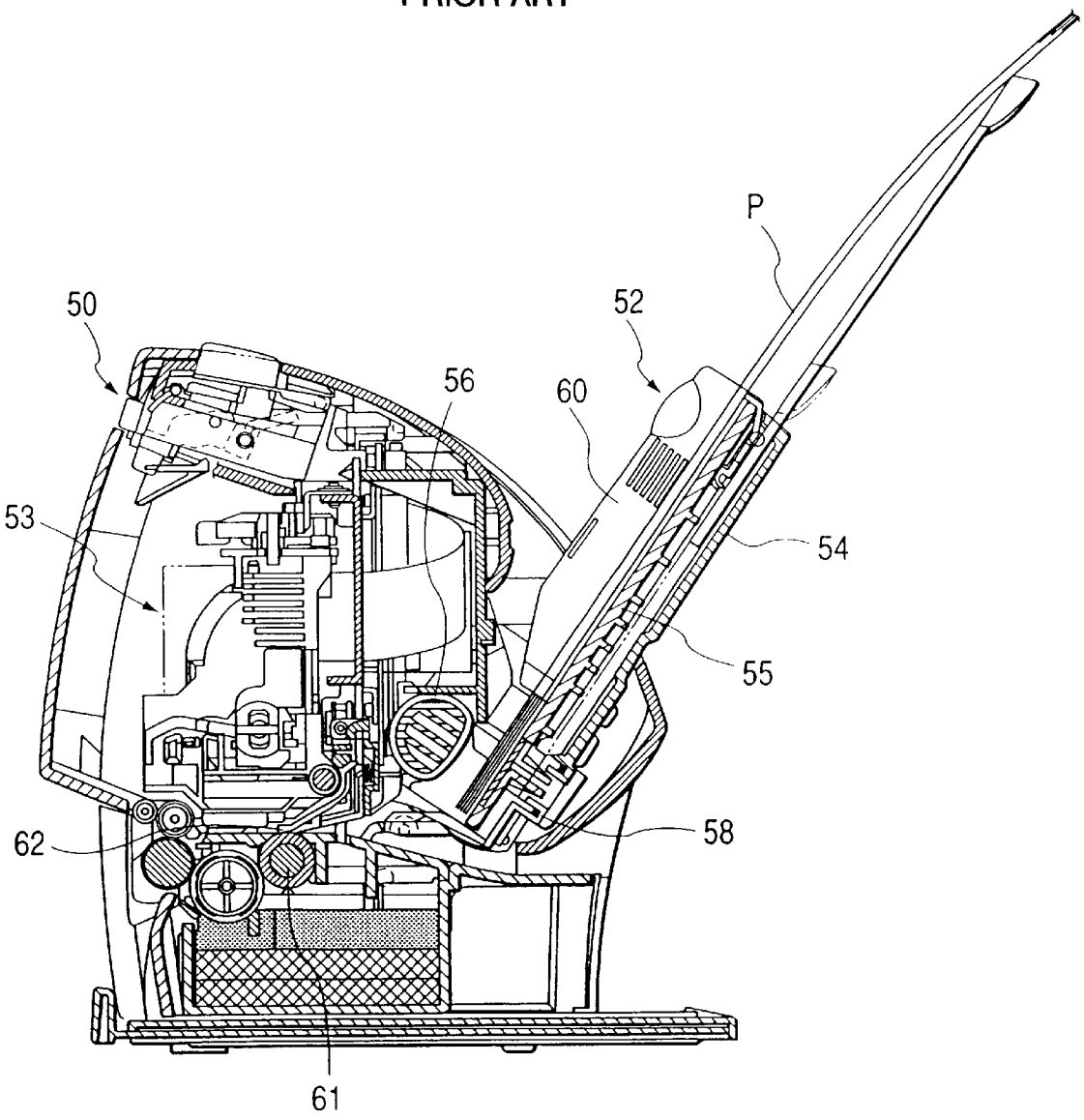
FIG. 7 PRIOR ART
FIG. 7 is a longitudinal cross-sectional view showing an example of the ink jet recording apparatus according to the prior art.
Figure 8:
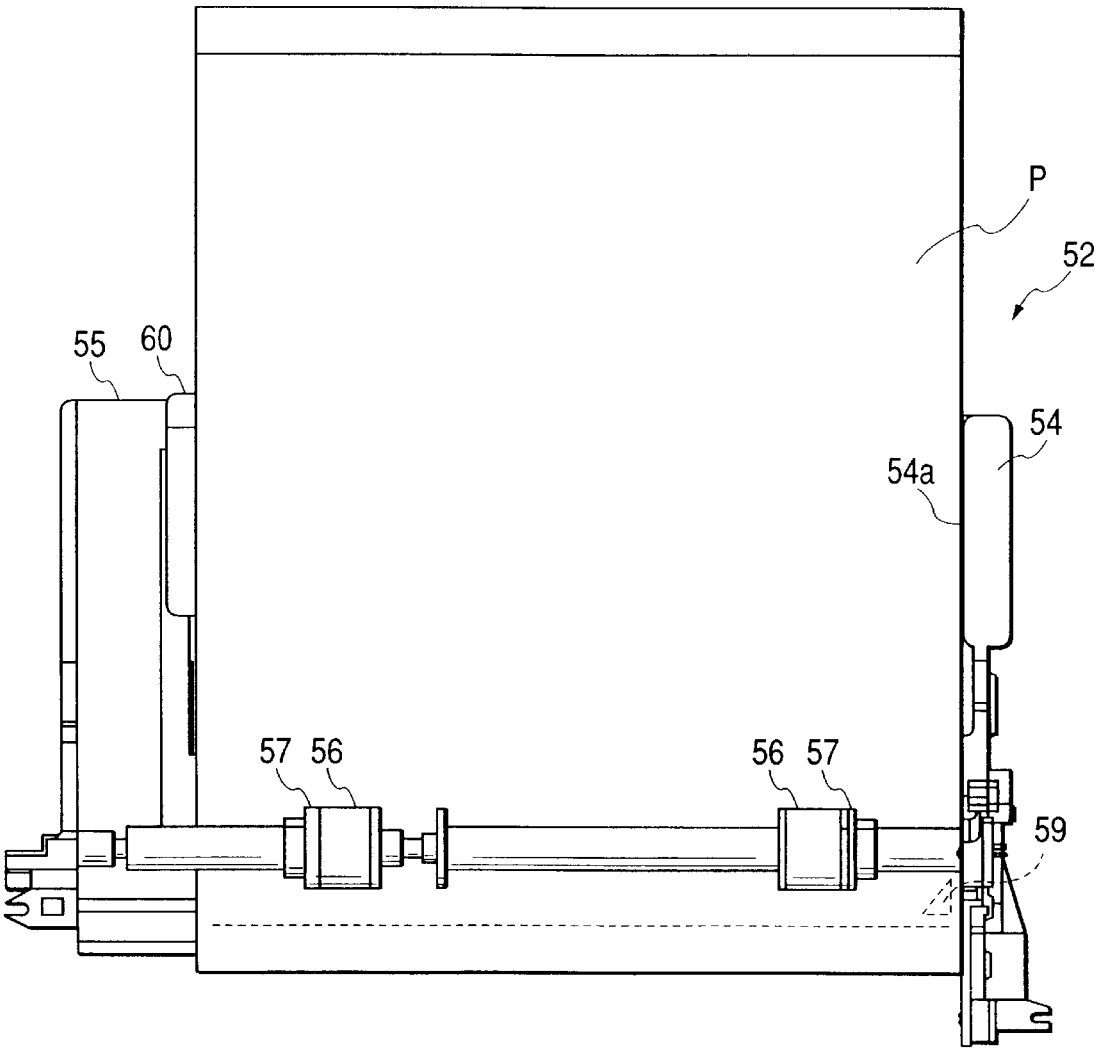
FIG. 8 PRIOR ART
FIG. 8 is a front view of an auto sheet feeder provided in the recording apparatus shown in FIG. 7.

When the size of the pressure plate 6 is minimized, if the movable side guide 4 and the pressure plate 6 are connected together by unevenness fitting, the maximum width of the recording sheet relative to the width of the apparatus will be limited, and a construction for coping with this is shown in FIG. 6.

A rib 4*e* extending in the widthwise direction of the apparatus is formed on the back of the movable side guide 4. A holding spring 42 urged against the rib 4*e* of the movable side guide 4 is provided on the pressure plate 6 side. Thereby, the movable side guide 4 can be moved to the lateral of the apparatus, and the size of recording sheets which can be set can be set to a large size.

The dispositional relation between the rib 4*e* and the holding spring 42 may be converse, and the holding spring 42 may be a molded spring integral with the pressure plate 6 or the movable side guide 4.

The present invention is not restricted to the contents written in the above-described embodiment, but for example, in the above-described embodiment, the separating pawl is disposed on one side of the corners of the leading end of the recording sheet, whereas separating pawls may be disposed at the both corners of the leading end of the recording sheet, and other separating system such as a friction separating system using a separating pad may be a doped instead of the separating pawl.

Further, while the above embodiment has been described with respect to the auto sheet feeder provided in the recording apparatus, the present invention may be applied to an auto document feeder (ADF) for feeding documents.

What is claimed is:

1. An auto sheet feeder comprising:

a main body;

a frame provided on said main body;

a pressure plate pivotally supported by said frame for supporting a sheet;

a feed roller for feeding the sheet supported by said pressure plate;

a first reference surface provided on said frame for regulating one side edge of the sheet in a widthwise direction of the sheet; and a second reference surface provided on said pressure plate for regulating the one side edge of the sheet in the widthwise direction, said second reference surface being disposed upstream of said first reference surface in a sheet feeding direction so that said second reference surface regulates the same side edge of the sheet as said first reference surface in the widthwise direction.

2. An auto sheet feeder according to claim 1, wherein a fitting portion for positioning said first reference surface and said second reference surface is disposed adjacently to a pivot shaft of said pressure plate.

3. An auto sheet feeder according to claim 2, wherein said fitting portion is of a construction in which a rib formed on said frame and extending in the sheet feeding direction and a rib formed on said pressure plate and extending in the sheet feeding direction are fitted to each other.

4. An auto sheet feeder according to claim 1, further comprising a side guide for regulating a second side edge of the sheet in the widthwise direction, the side guide being opposed to said first reference surface and said second reference surface in the widthwise direction, wherein said guide is moveable in the widthwise direction.

5. An auto sheet feeder according to claim 4, wherein a holding spring for securing said side guide is provided between said side guide and said pressure plate.

6. An auto sheet feeder according to claim 1, further comprising release means for pivotally moving said pressure plate in association with a feeding operation of said feed roller to thereby separate the sheet supported by said pressure plate from said feed roller.

7. An auto sheet feeder according to claim 1, further comprising a sheet supply tray disposed upstream of said pressure plate in the sheet feeding direction, wherein a supporting surface for supporting sheets on said sheet supply tray is convexed protrudingly toward a side on which the sheet is supported.

8. A recording apparatus for recording onto a sheet by a recording head comprising:

a main body;

a recording head mounting portion for mounting the recording head;

a frame provided on the main body of said recording apparatus;

a pressure plate pivotally supported by said frame for supporting a sheet;

a feeder roller for feeding the sheet supported by said pressure plate;

a first reference surface provided on said frame for regulating one side edge of the sheet in a widthwise direction of the sheet; and a second reference surface provided on said pressure plate for regulating the one side edge of the sheet in the widthwise direction, said second reference surface being disposed upstream of said first reference surface in a sheet feeding direction so that said second reference surface regulates the same side edge of the sheet as said first reference surface in the widthwise direction.

9. A recording apparatus according to claim 8, wherein a fitting portion for positioning said first reference surface and said second reference surface is disposed adjacently to a pivot shaft of said pressure plate.

10. A recording apparatus according to claim 9, wherein said fitting portion is of a construction in which a rib formed on said frame and extending in the sheet feeding direction and a rib formed on said pressure plate and extending in the sheet feeding direction are fitted to each other.

11. A recording apparatus according to claim 8, further comprising a side guide for regulating a second side edge of the sheet, the side guide being opposed to said first reference surface and said second reference surface in the widthwise direction, wherein said side guide is moveable in the widthwise direction.

12. A recording apparatus according to claim 11, wherein a holding spring for securing said side guide is provided between said side guide and said pressure plate.

13. A recording apparatus according to claim 8, further comprising release means for pivotally moving said pressure plate in association with a feeding operation of said feed roller to thereby separate the sheet supported by said pressure plate from said feed roller.

14. A recording apparatus according to claim 13, further comprising a sheet supply tray disposed upstream of said pressure plate in the sheet feeding direction, wherein a supporting surface for supporting the sheet of said sheet supply tray is convexed protrudingly toward a side on which the sheet is supported.

* * * * *

UNITED STATES PATENT AND TRADEMARK OFFICE

CERTIFICATE OF CORRECTION

PATENT NO. : 6,416,050 B1 
DATED : July 9, 2002
INVENTOR(S) : Takeji Niikura

It is certified that error appears in the above-identified patent and that said Letters Patent is hereby corrected as shown below:

Column 2,
Line 4, “rollers 56” should read -- rollers 56, 56 --.

Column 5,
Line 56, “space” should read -- spacing --.

Column 6,
Line 39, “such as other thick paper than plain paper” should read -- than plain paper, such as other thick paper, --.

Column 9,
Line 10, “unevenness” should read -- uneven --.
Line 33, “lateral” should read -- lateral side --.
Line 37, “integral” should read -- integrated --.
Line 46, “a” (2nd occurrence) should be deleted
Line 47, “doped” should read -- adapted --.

Signed and Sealed this

Twenty-fourth Day of December, 2002

JAMES E. ROGAN
*Director of the United States Patent and Trademark Office*